US008567097B2

(12) United States Patent
Edy et al.

(10) Patent No.: US 8,567,097 B2
(45) Date of Patent: Oct. 29, 2013

(54) SHOE SOLE

(75) Inventors: Clinton Wayne Edy, Wolsingham (GB); Philip Rees, Derby (GB); Graham Jordison, Wolsingham (GB)

(73) Assignee: Inoveight Limited (GB)

( * ) Notice: Subject to any disclaimer, the term of this patent is extended or adjusted under 35 U.S.C. 154(b) by 901 days.

(21) Appl. No.: 11/995,883

(22) PCT Filed: Jul. 19, 2006

(86) PCT No.: PCT/GB2006/002691
§ 371 (c)(1),
(2), (4) Date: Jun. 25, 2008

(87) PCT Pub. No.: WO2007/010253
PCT Pub. Date: Jan. 25, 2007

(65) Prior Publication Data

US 2009/0056166 A1 Mar. 5, 2009

(30) Foreign Application Priority Data

Jul. 20, 2005 (GB) ..... 0514846.5

(51) Int. Cl.
*A43B 7/14* (2006.01)
*A43B 5/00* (2006.01)
*A43B 13/00* (2006.01)

(52) U.S. Cl.
USPC ..... 36/88; 36/107; 36/91

(58) Field of Classification Search
USPC ..... 36/88, 91, 114, 25 R, 145, 180, 76 R, 36/140, 179, 107
See application file for complete search history.

(56) References Cited

U.S. PATENT DOCUMENTS

| | | | | | |
|---|---|---|---|---|---|
| 881,974 | A * | 3/1908 | Toporczer | 36/179 |
| 1,219,890 | A * | 3/1917 | West | 36/44 |
| 1,240,249 | A * | 9/1917 | Peckham | 36/76 R |
| 1,470,618 | A * | 10/1923 | Craine | 36/179 |
| 1,811,912 | A * | 6/1931 | White | 36/76 R |
| 2,129,424 | A * | 9/1938 | Jay | 36/76 R |
| 2,386,667 | A * | 10/1945 | Doherty | 36/30 R |
| 6,968,637 | B1 * | 11/2005 | Johnson | 36/88 |

* cited by examiner

*Primary Examiner* — Jila M Mohandesi
(74) *Attorney, Agent, or Firm* — Workman Nydegger

(57) ABSTRACT

A sole adapted to provide improved leverage during the toe-off stage of gait comprises elongate elements (2*a-e*) along the horizontal surface of the sole. The elongate elements (2*a-e*) are adapted to tauten in response to longitudinal forces on the sole, increasing the rigidity of the midsection of the sole and providing effective propulsive assistance to the athlete.

32 Claims, 4 Drawing Sheets

SHOE SOLE

Figure 1:
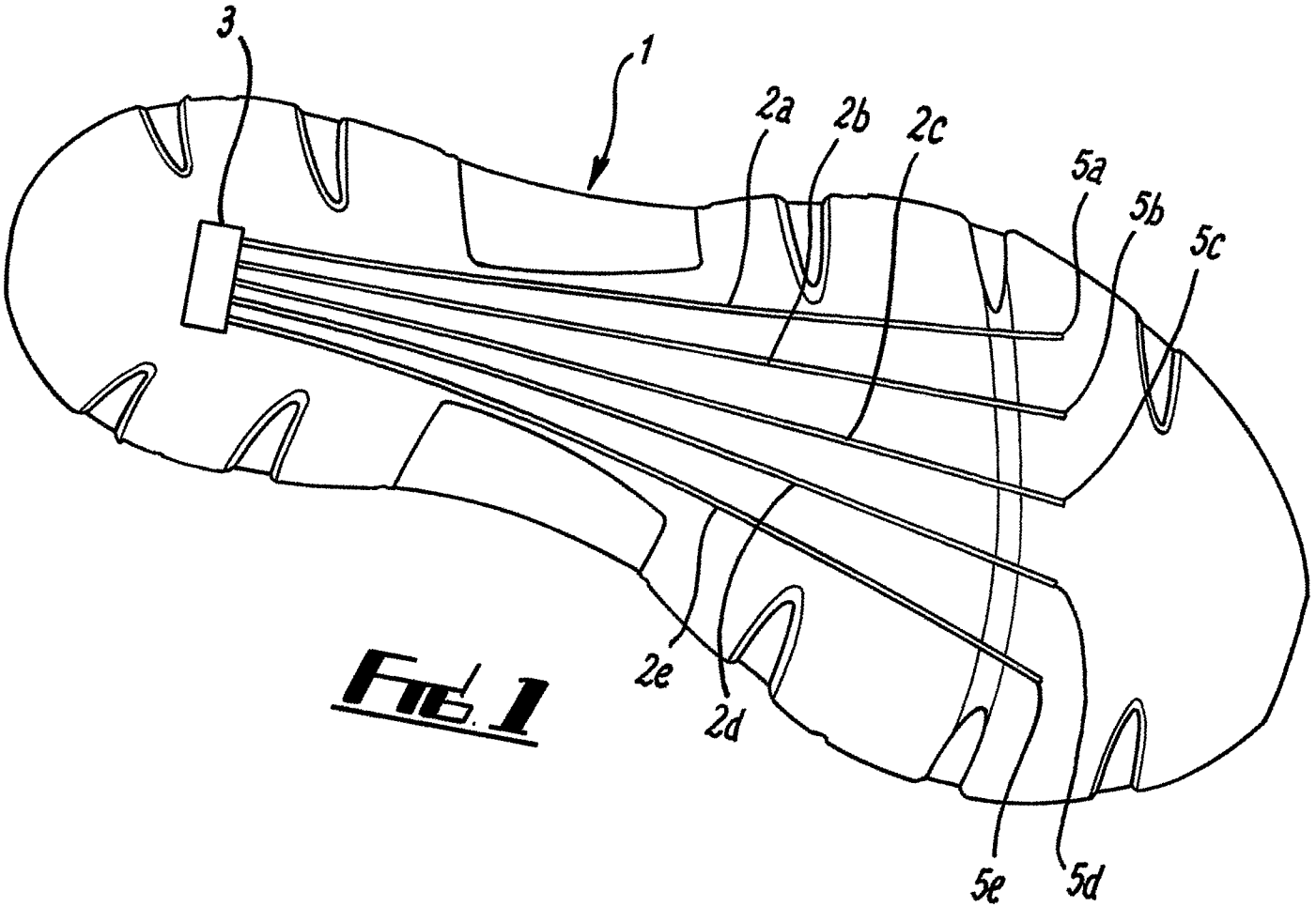

The present invention relates to the fabrication and construction of shoe soles as well as athletic shoes incorporating such soles. In particular, the invention relates to a shoe sole adapted for improved performance due to its ability to provide improved leverage during the toe-off stage of gait.

Athletic shoes have been developed to minimise the negative effect of taking the foot out of its natural environment. However, thus far these shoes have not been designed to assist the foot and to improve gait above the foot's natural performance.

The plantar fascia is a band of fibrous connective tissue that runs along the bottom of the foot. The human plantar fascia originates at the anterior-medial aspect of the calcaneal tubercle and diverges medially and laterally as it courses anteriorly towards the forefoot. The fascia then divides into five bands in the region of the metatarsal bases and continues anteriorly towards the five toes. As the bands near the metatarsal heads, they divide into two further bands. One band passes superficially to the skin. The deeper band bifurcates, with the two branches passing around and superior to the flexor tendons. The bifurcating branches then merge with the flexor sheet of the toe and deep transverse ligaments.

The primary function of the plantar fascia is to provide support and stability to the arch of the foot during weight bearing. Walking and running are the two most common forms of human gait and there are typically three stages; the contact stage, the midstance stage and the propulsive stage. Heel lift commences the propulsive phase, and it is at this point, as the heel is elevated from the ground, that the body weight is transferred from the posterior aspect of the foot to the anterior aspect of the foot. As the weight is transferred, a tension stress is applied to the plantar fascia so that the tissue is pulled tight along the bottom of the foot. Due to the limited elasticity of the plantar fascia, the plantar fascia stretches in a bowstring-like fashion to its elastic limit, becoming taut. This "windlass" effect raises the arch of the foot and turns the midfoot into a rigid lever, helping to propel the body forward.

Repeated stress on the tissue due to inefficient foot function can lead to inflammation of the plantar fascia. Plantar fasciitis is a common orthopaedic problem and is prevalent in athletic adults.

The present invention identifies the benefit of providing a sole for a shoe which works in synergy with the natural motion of the foot and assists natural gait.

The aims and objects of the invention will become apparent from reading the following description.

According to a first aspect of the present invention there is provided a sole comprising at least one elongate element which is adapted to increase in rigidity when placed under tension, the at least one elongate element being oriented longitudinally within the horizontal plane of the sole.

Preferably the elongate element is adapted to become substantially rigid when placed under tension, the at least one elongate element being oriented longitudinally within the horizontal plane of the sole.

Preferably, the elongate element is adapted to tauten in response to an increase in the longitudinal tension on the sole.

Optionally, the elongate element is adapted to provide resistance to longitudinal extension of the sole wherein the resistance is maximised substantially towards the anterior of the sole.

Providing at least one elongate element in this manner will allow the sole to provide support to the medial arch of the foot by resisting the elongation of the sole due to the increase in longitudinal tension on the sole when body weight is applied thereto.

Advantageously, the elongate element will function as an additional propulsive element by increasing the rigidity of the midsection of the sole as the vertical force imparted on the sole is increased by the transfer of weight from the posterior to the anterior of the sole during the step sequence. The rigidity produced by the resistance of the sole is proportional to the load transmitted through the foot to the ground.

Furthermore, and advantageously, as the resistance of the elongate element is dependent on the pressure applied to the sole, the resistance on the sole of the shoe will vary during the step sequence. This allows for the combination of flexibility and rigidity that is required to provide the foot with propulsive leverage at the toe-off stage whilst allowing a degree of flexibility during the contact and midstance stages of gait.

The term "tauten" is used throughout this specification to indicate that the elongate element can stretch slightly when placed under tension until it reaches an inelastic limit at which it becomes inextensible. Alternatively, the elongate element can be formed of an inelastic material which becomes tight when placed under tension.

The term "sole" can be taken to be either an integral sole, outsole or midsole or combination of the two, or a footbed or orthotic section which can be inserted into a shoe.

The term "shoe" is intended to cover a variety of footwear including, but not limited to, athletic shoes, walking boots and football boots.

The term "posterior" is taken to mean towards the rear (heel) of the sole or foot.

The term "anterior" is taken to mean towards the front (toe) of the sole or foot.

Preferably, the sole comprises a plurality of elongate elements.

More preferably, the sole comprises five elongate elements.

Optionally, the sole comprises three elongate elements.

Optionally, the elongate elements are conjoined at one end.

Optionally, the elongate elements are conjoined at the posterior end.

Preferably, the elongate element extends from the centre of the heel (posterior) portion of the sole towards the base of the toe (anterior) portion of the sole.

More preferably, the elongate element extends from a position corresponding to the anterior-medial aspect of the calcaneal tubercle towards a position anterior to the metatarsal heads.

Alternatively, the elongate element extends from the centre of the heel (posterior) portion of the sole towards the anterior midsection of the sole.

Preferably, the sole comprises an upper sole, a mid-sole and an outer sole.

Optionally, the sole comprises a mid-sole and an outer sole.

Preferably the elongate element is provided at the mid-sole.

Optionally the elongate element is provided at the outer sole.

Alternatively, the elongate element is provided at the upper sole.

Preferably, the elongate element can move independently of the surrounding structures of the sole.

Preferably, the elongate element is provided with two anchor points which affix the elongate element to the sole.

Most preferably, the elongate element is provided with anchor points at the posterior and anterior ends.

Optionally, the elongate element is provided with additional anchor points.

Alternatively, the elongate element is an integral part of the sole.

Preferably, the elongate element is formed of an inelastic material.

Optionally, the elongate element is formed of a material with a low elastic limit.

Optionally, the elongate element is formed of an elastic material.

Advantageously, the material of the elongate element can be chosen with regard to its elastic limit so that a range of shoe soles for different activities and end-users can be provided under the teachings of the invention. For example, a higher elastic limit is required for a sole to be used in a gymnastic or ballet shoe, in which a greater degree of flexibility is required.

Preferably the elongate element is formed of rubber.

Optionally the elongate element is formed of any suitable material.

Preferably the elongate element is formed of a material which is capable of withstanding a load of at least 115% of the body mass of the wearer.

The aforesaid optional and preferred features of the sole of the present invention may be incorporated in a shoe provided according to second aspect of the invention.

Thus according to a second aspect of the present invention there is provided a shoe, the shoe comprising an upper and a sole, the sole comprising at least one elongate element adapted to become substantially rigid when placed under tension, the elongate element being oriented longitudinally within the horizontal plane of the sole.

Figure 2:
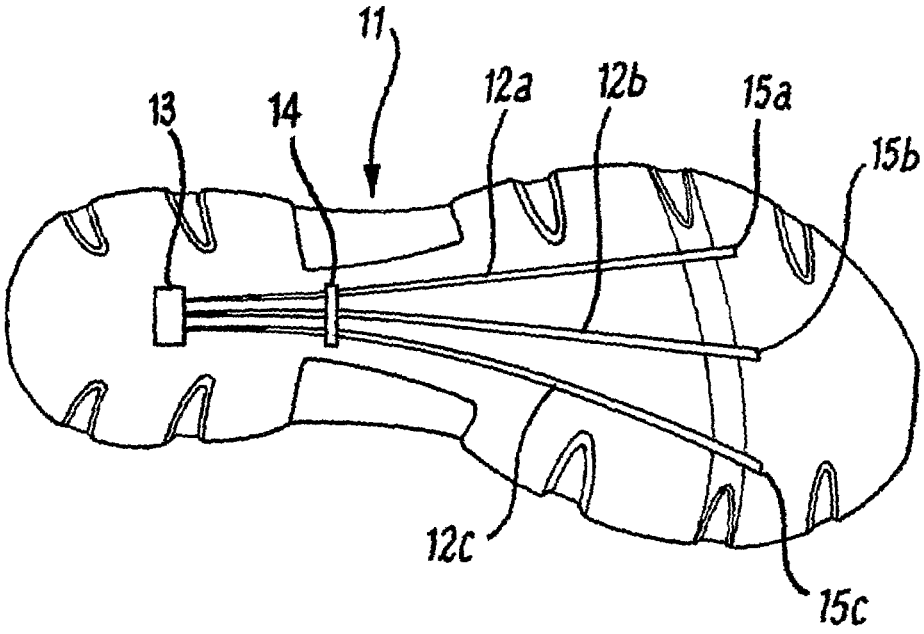
Figure 3:
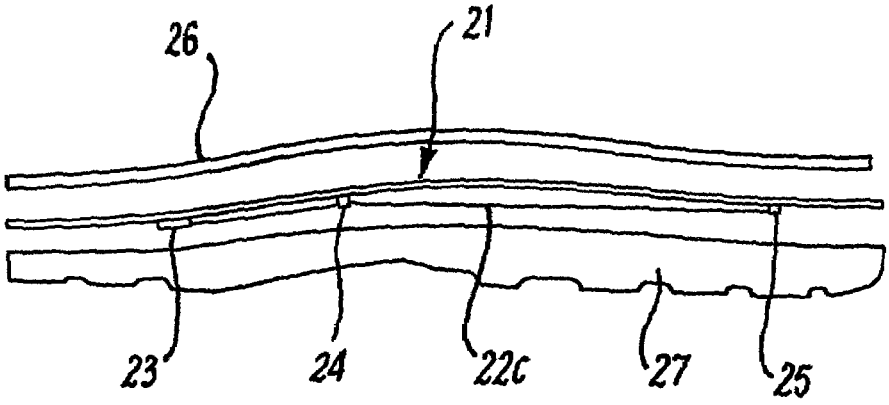
Figure 4:
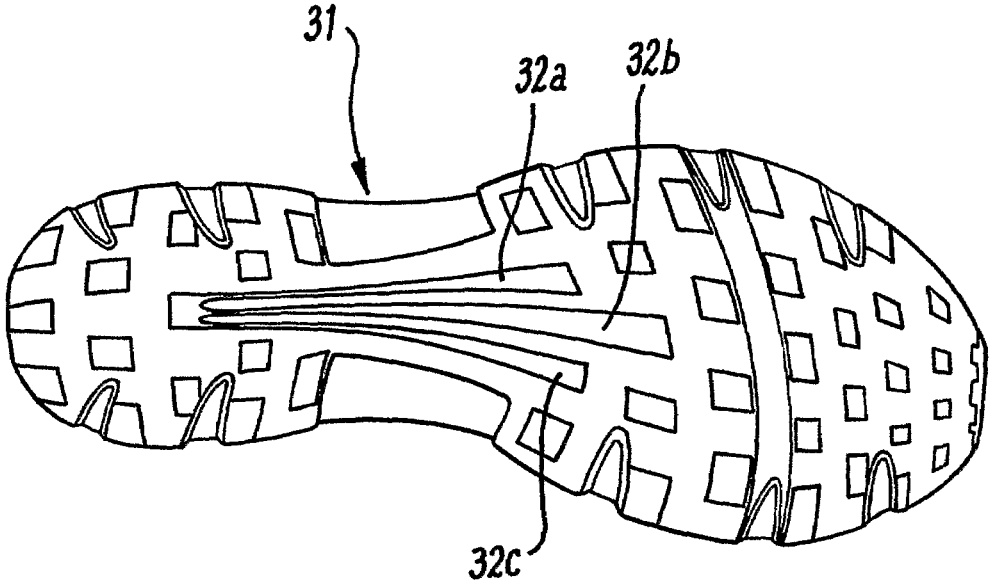

Preferred embodiments of the invention will now be described by way of illustration with reference to the accompanying drawings in which:

FIG. 1 shows a plan view of a sole according to the preferred embodiment of the invention; and FIG. 2 shows a plan view of a sole according to an alternative embodiment of the invention; and FIG. 3 shows an exploded cross-section view from the lateral side of a sole according to the preferred embodiment of the invention; and FIG. 4 shows a plan view of a sole according to an alternative embodiment of the invention.

Referring firstly to FIG. 1, the drawing shows a sole generally depicted at 1. In the preferred and depicted embodiment the sole 1 represents a mid-sole which is sandwiched between an upper and an outer sole. The sole 1 comprises five elongate elements 2*a-e* which are provided longitudinally along the horizontal plane of the sole. The elongate elements 2*a-e* comprise thin bands of inelastic material which are fixed to the sole 1 at a point 3 corresponding to the anterior-medial aspect of the calcaneal tubercle, and extend anteriorly in a substantially parallel fashion along the sole of the shoe towards the front of the foot. As the elongate elements extend anteriorly past the central position of the sole they begin to diverge towards their final anchor points 5*a-e* at the base of the toes. The elongate elements 2*a-e* are fixed to the sole 1 by moulding at the anchor points 3 and 5*a-e* so that they have a degree of freedom of movement with respect to the surrounding structures of the sole between these anchor points. As the mid-sole is sandwiched between an upper and an outer sole, the elongate elements 2*a-e* are also encased between the upper and outer soles.

While in the above-described embodiment the elongate elements are affixed to the sole by moulding, it will be understood that the elongate elements can be affixed to the sole by any suitable means such as chemical bonding, gluing or stitching. Optionally the elongate elements can be provided integral with the sole. Furthermore, while in the depicted embodiment the elongate elements are encased in the sole, the elongate elements may also be provided at the outsole. Optionally the elongate elements may be provided within channels in the sole.

In use, the elongate elements 2*a-e* of the sole 1 function in a similar fashion to the plantar fascia and work in synergy with the natural motion of the foot. As stress is applied to the sole of the shoe due to vertical forces from the body weight and ground reaction forces, the sole flexes and lengthens, pulling the elongate elements 2*a-e* taut. As the elongate elements 2*a-e* are pulled taut, they resist further lengthening of the sole and increase the rigidity of the midsection of the shoe. This windlass effect provides a stiffness to the sole proportional to the load transmitted through the foot to the ground and gives effective propulsive assistance through the provision of an additional mechanical lever within the sole; duplicating and strengthening the natural work of the plantar fascia.

Although the preferred and depicted embodiment utilises five elongate elements, it can be envisaged that so long as one elongate element is present, an alternative number of elongate elements can be used.

Referring now to FIG. 2, the drawing shows a sole generally depicted at 11. In this alternative and depicted embodiment the sole 11 represents a mid-sole which is sandwiched between an upper and an outer sole. The sole 11 comprises three elongate elements 12*a-c* which are provided longitudinally along the horizontal plane of the sole. The elongate elements 12*a-c* comprise thin bands of material with a low elastic limit which are fixed to the sole 11 at a point 13 corresponding to the anterior-medial aspect of the calcaneal tubercle, and extend anteriorly in a substantially parallel fashion along the sole of the shoe towards the front of the foot. The elongate elements 12*a-c* are bridged at a point 14, at the central position of the sole. This bridge 14 maintains the elongate elements in a semi-taut position and provides support to the elongate elements. Anterior to this bridge point 14, the elongate elements 12*a-c* begin to diverge with the three elements extending anteriorly to their final anchor points 15*a-c* at the base of the toes. The elongate elements are attached to the sole at the anchor points 13 and 15*a-c* by glue.

Referring now to FIG. 3, the drawing shows a mid-sole generally depicted at 21, similar to the sole as described for the previous Figure. The mid-sole 21 is flanked on either side by an upper sole 26 and an outer sole 27. One of the elongate elements 22*c* is visible in this Figure and extends between two anchoring positions at the middle of the heel 23 and the base of the toes 25. A bridge point 24 in the middle of the sole maintains the elongate elements in a semi-taut position. This allows the elongate elements to fully tauten in response to minor longitudinal expansion of the sole.

While an upper sole, a midsole and an outer sole are all present in the above depictions of the invention, it will be understood that the three sole sections are not all required for the invention to be performed, once a sole section is present. Furthermore, in an alternative embodiment the elongate element or elements may be provided in an upper or an outer sole section.

A yet further alternative embodiment of the invention is shown in FIG. 4. The drawing depicts a sole, generally depicted at 31. The sole in this embodiment is an outsole. The sole comprises three elongate elements in the form of longitudinal bands indicated at 32*a,b,c*. The longitudinal bands 32*a,b,c* extend anteriorly from the centre of the heel of the foot where they are conjoined towards the ball of the foot. The longitudinal bands 32*a,b,c* are formed from the same material as the outsole 31, but are thicker than the material of the sole so that the protrude gently therefrom. The increased thickness of the longitudinal bands 32*a,b,c* results in increased resistance to the longitudinal expansion of the sole. The longitudinal bands are of asymmetrical width, becoming wider as they extend in an anterior direction. The resistance on the sole is thereby manipulated so that the resistance is increased as the weight is shifted towards the anterior of the foot with increased resistance being provided towards the anterior of the sole where the bands are at their widest. This allows the longitudinal bands to provide improved leverage to the foot during the toe-off stage of gait. In the depicted embodiment, the central band 32*b* is longer than the remaining bands, however, it will be understood that the relative lengths of the bands can be adjusted within the scope of the invention. Furthermore, the width of the longitudinal bands may be uniform along the length of the bands or may be asymmetrical with the bands widening towards the posterior, or along the centre of the bands.

It will be evident that various modifications and improvements could be made to the above-described sole within the scope of the invention. For example, the above description is written in the context of an athletic shoe. However, the invention applies equally to any shoes or boots.

Further modifications may be made without departing from the scope of the invention herein intended.

The invention claimed is:

1. A sole comprising at least three unitary elongate elements oriented longitudinally within the sole, each of the at least three elongate elements having two opposing anchor points, a first anchor point being fixedly connected to a first point of the sole in a manner that prevents lateral movement of the first anchor point relative to the first point of the sole, and a second anchor point being fixedly connected to a second point of the sole in a manner that prevents lateral movement of the second anchor point relative to the second point of the sole, each of the at least three elongate elements extends between the first and second points of the sole from a position corresponding to the anterior-medial aspect of the calcaneal tubercle towards a position anterior to the metatarsal heads, the at least three elongate elements are conjoined at the position corresponding to the anterior-medial aspect of the calcaneal tubercle, each one of the at least three elongate elements is adapted to move independently of its surrounding structures of the sole between the two opposing anchor points, and wherein relative movement of the two opposing anchor points away from each other tensions each of the at least three elongate elements.

2. A sole as claimed in claim 1, wherein the at least three elongate elements are adapted to become substantially rigid when placed under tension.

3. A sole as claimed in claim 1, wherein the at least three elongate elements are adapted to provide resistance to longitudinal extension of the sole.

4. A sole as claimed in claim 3, wherein the resistance is maximized substantially towards the anterior of the sole.

5. A sole as claimed in claim 1, wherein the sole comprises five elongate elements.

6. A sole as claimed in claim 1, wherein the sole comprises an upper sole, a mid-sole and an outer sole.

7. A sole as claimed in claim 1, wherein the sole comprises a mid-sole and an outer sole.

8. A sole as claimed in claim 7, wherein the at least three elongate elements are provided at the mid-sole.

9. A sole as claimed in claim 7, wherein the at least three elongate elements are provided at the outer sole.

10. A sole as claimed in claim 6, wherein the at least three elongate elements are provided at the upper sole.

11. A sole as claimed in claim 1, wherein the at least three elongate elements are provided with additional anchor points.

12. A sole as claimed in claim 1, wherein the at least three elongate elements are an integral part of the sole.

13. A sole as claimed in claim 1, wherein the at least three elongate elements are formed of a material with a low elastic limit.

14. A sole as claimed in claim 1, wherein the at least three elongate elements are formed of an elastic material which is near its elastic limit.

15. A sole as claimed in claim 1, wherein the at least three elongate elements are formed of a material which is capable of withstanding a load of at least 115% of the body mass of the wearer.

16. A sole as claimed in claim 1, wherein the at least three elongate elements are substantially inelastic.

17. A sole as claimed in claim 1, wherein the at least three elongate elements are adapted to tauten in response to an increase in the longitudinal tension on the sole.

18. A sole as claimed in claim 1, wherein the at least three elongate elements extend from the center of the heel (posterior) portion of the sole towards the anterior midsection of the sole.

19. A sole as claimed in claim 6, wherein the at least three elongate elements are provided at the mid-sole.

20. A sole as claimed in claim 6, wherein the at least three elongate elements are provided at the outer sole.

21. The sole as claimed in claim 1, wherein each of the at least three elongate elements are oriented longitudinally within a horizontal plane of the sole.

22. The sole as claimed in claim 1, wherein as the at least three elongate elements extend past a central position of the sole, the at least three elongate elements diverge away from each other toward respective anchor points.

23. The sole as claimed in claim 1, further comprising a bridge supporting and at least partially tensioning the at least three elongate elements.

24. The sole as recited in claim 23, wherein the bridge is positioned between the first and second opposing anchor points.

25. A shoe comprising an upper and a sole wherein the sole comprises at least three unitary elongate elements oriented longitudinally within the sole, each of the at least three elongate elements having two opposing anchor points, a first anchor point being fixedly connected to a first point of the sole in a manner that prevents lateral movement of the first anchor point relative to the first point of the sole, and a second anchor point being fixedly connected to a second point of the sole in a manner that prevents lateral movement of the second anchor point relative to the second point of the sole, each of the at least three elongate elements extends between the first and second points of the sole from a position corresponding to the anterior-medial aspect of the calcaneal tubercle towards a position anterior to the metatarsal heads, the at least three elongate elements are conjoined at the position corresponding to the anterior-medial aspect of the calcaneal tubercle, each one of the at least three elongate elements is adapted to move independently of its surrounding structures of the sole between the two opposing anchor points, and wherein each of the at least three elongate elements is placed under tension in response to relative lateral movement of the two anchor points away from each other.

26. A shoe sole comprising:

a sole member; and at least three unitary elongate elements extending longitudinally with respect to the sole member, each of the at least three elongate elements having two opposing anchor points, a first anchor point being fixedly connected to a first point of the sole member in a manner that prevents lateral movement of the first anchor point relative to the first point of the sole member, and a second anchor point being fixedly connected to a second point of the sole member in a manner that prevents lateral movement of the second anchor point relative to the second point of the sole member, each of the at least three elongate elements extending between the first and second points of the sole member from a position corresponding to the anterior-medial aspect of the calcaneal tubercle towards a position anterior to the metatarsal heads, the at least three elongate elements being conjoined at the position corresponding to the anterior-medial aspect of the calcaneal tubercle, each one of the at least three elongate elements being adapted to move independently of its surrounding structures of the sole member between the two opposing anchor points, and wherein relative movement of two opposing anchor points away from each other tensions a corresponding elongate element, such that each elongate element tautens in response to an increase in longitudinal tension on the shoe sole.

27. A shoe sole as claimed in claim 26, wherein the sole member comprises a mid-sole member.

28. A shoe sole as claimed in claim 26, wherein the sole member comprises an upper-sole member.

29. A shoe sole as claimed in claim 26, wherein the sole member comprises an outer-sole member.

30. A shoe sole as claimed in claim 26, wherein the sole member comprises an outer-sole member.

31. A shoe sole as claimed in claim 26, wherein the shoe sole is integrated into a shoe.

32. A shoe sole as claimed in claim 26, wherein the shoe sole is configured as a footbed or orthotic adapted to be inserted into a shoe.

* * * * *

UNITED STATES PATENT AND TRADEMARK OFFICE

CERTIFICATE OF CORRECTION

PATENT NO. : 8,567,097 B2
APPLICATION NO. : 11/995883
DATED : October 29, 2013
INVENTOR(S) : Edy et al.

It is certified that error appears in the above-identified patent and that said Letters Patent is hereby corrected as shown below:

In the Specification

Column 1
Line 29, change "three stages; the" to --three stages: the--

Column 3
Line 58, change "at the anchor points 3 and 5*a-e*" to --at the point 3 and the anchor points 5*a-e*--

Column 4
Line 43, change "at the anchor points 13 and 15*a-c*" to --at the point 13 and the anchor points 15*a-c*--

Signed and Sealed this
Eighteenth Day of February, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,567,097 B2
APPLICATION NO. : 11/995883
DATED : October 29, 2013
INVENTOR(S) : Edy et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1108 days.

Signed and Sealed this
Fifteenth Day of September, 2015

Michelle K. Lee

Michelle K. Lee
*Director of the United States Patent and Trademark Office*